United States Patent [19]

Hall et al.

[11] Patent Number: 4,736,681

[45] Date of Patent: Apr. 12, 1988

[54] ELECTRONIC ENCODER

[75] Inventors: Phillip E. Hall, Scottsdale; Larry M. Boxman, Phoenix; Robert L. Wannemacher, Mesa; Donald R. Griswold, Scottsdale, all of Ariz.

[73] Assignee: Motorola, Inc., Schaumburg, Ill.

[21] Appl. No.: 798,505

[22] Filed: Nov. 15, 1985

[51] Int. Cl.[4] ..... F42C 17/00

[52] U.S. Cl. ..... 102/215; 89/6.5

[58] Field of Search ..... 89/6.5, 6; 102/215, 102/200, 221, 270

[56] References Cited

U.S. PATENT DOCUMENTS

| | | | |
|---|---|---|---|
| 3,371,579 | 3/1968 | Kinzelman | 89/6 |
| 3,500,746 | 3/1970 | Ambrosini | 89/6.5 |
| 3,721,806 | 3/1973 | Stothart | 340/347 P |
| 4,005,631 | 2/1977 | Kaiser et al. | 89/6.5 |
| 4,031,386 | 6/1977 | Recker | 250/231 SE |
| 4,072,108 | 2/1978 | Lewis et al. | 89/6 |
| 4,424,745 | 1/1984 | Magorian et al. | 102/215 |
| 4,475,034 | 10/1984 | Maddox et al. | 340/347 P |
| 4,577,561 | 3/1986 | Perry | 102/215 |

*Primary Examiner*—Charles T. Jordan

*Attorney, Agent, or Firm*—Maurice J. Jones, Jr.; Eugene A. Parsons; Raymond J. Warren

[57] ABSTRACT

An electronic encoder for use in setting fuzes in munitions and the like. The electronic encoder comprising: a switch which activates the electronic encoder by coupling in the power supply and which is used to set the electronic encoder; a display for displaying the setting of the electronic encoder; a display driver for driving the display; a selector operated by the switch for selecting a digit of the display to be set; and a setting device operated by the switch for setting the portion of the display. This setting, when completed, is transmitted to the fuse of the munition or the like.

23 Claims, 5 Drawing Sheets

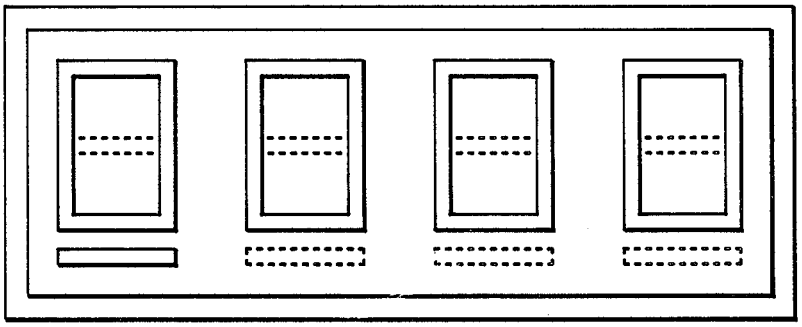
FIG. 2A
10
10
FIG. 2B
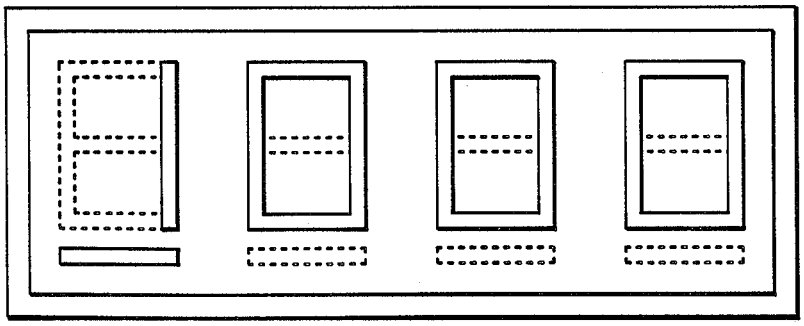
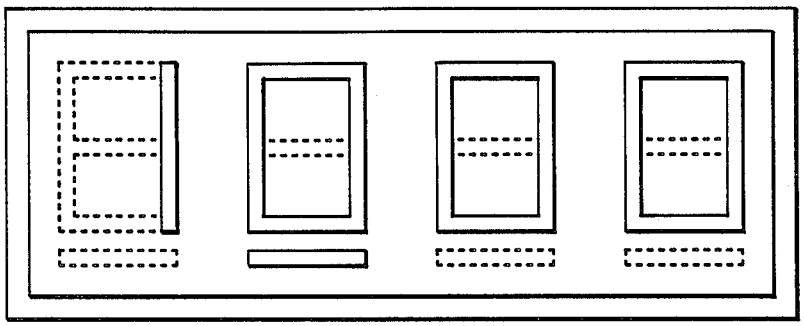
10
FIG. 2C
FIG. 2D
10
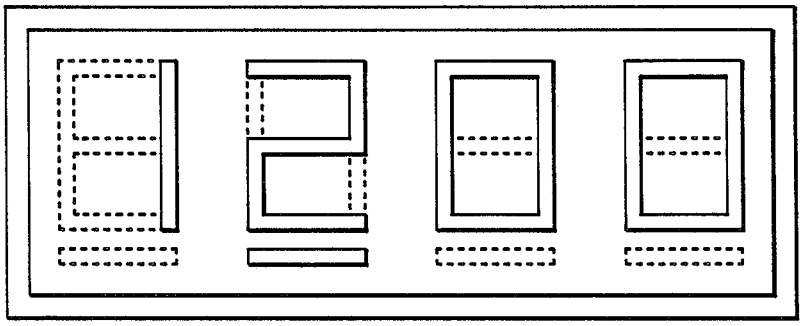

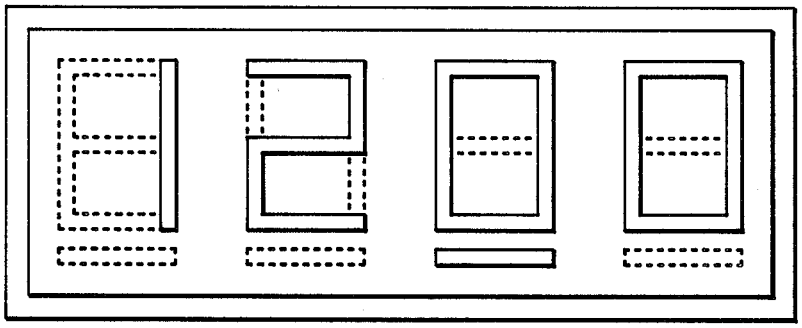
FIG. 2E 10
10 FIG. 2F
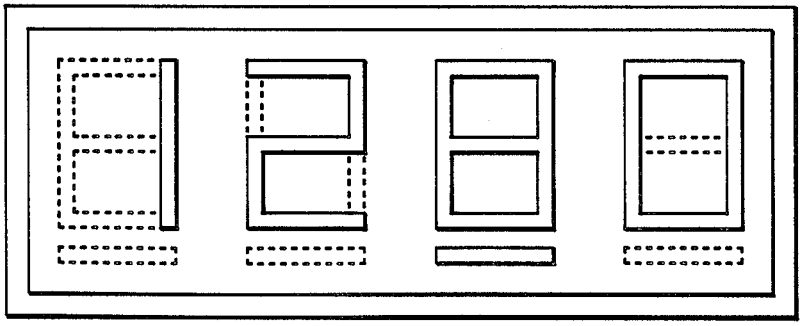
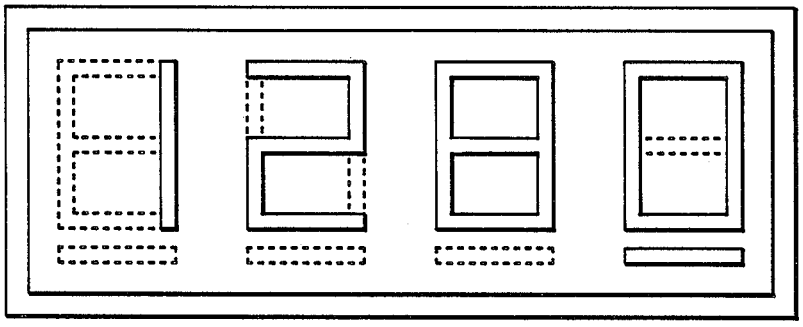
10 FIG. 2G
FIG. 2H 10
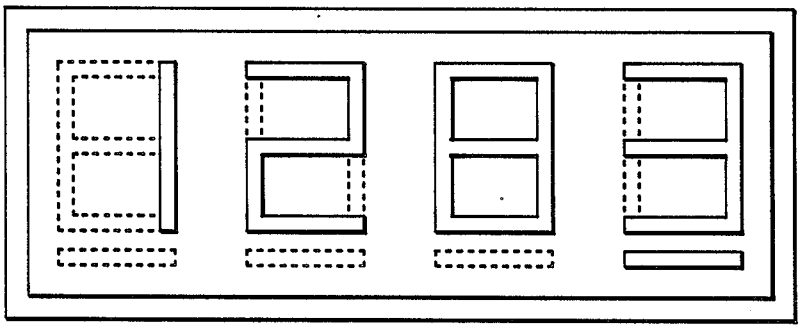

ELECTRONIC ENCODER

BACKGROUND OF THE INVENTION

This invention relates, in general, to encoders and, more particularly, to electronic encoders for use with munition fuzes and the like.

Many mechanical encoders are known in the art such as U.S. Pat. Nos. 4,475,034 entitled "Modular Shaft Encoder" developed by Maddox et al.; 4,072,108 entitled "Fuze Encoder Device" developed by Lewis et al.; 4,031,386 entitled "Optical Transducer Encoding Apparatus" developed by Recker; and 3,721,806 entitled "Digital Encoder For Mechanical Counters" developed by Stothart. An encoder is a device that operates to set the fuze circuitry of a munition, or the like. The encoder is generally used to set any one of a number of options such as time to destruct, time after impact, proximity turn-on, proximity height of burst and the like.

Mechanical encoders have several drawbacks including: the large size as compared to their electrical counterparts; the increased number of components; questionable reliability due to the movable mechanical parts involved; and inability to conduct a self test.

SUMMARY OF THE INVENTION

Accordingly, it is an object of the present invention to provide an electronic encoder and method of operation that overcomes the deficiencies set fourth above.

A further object of the present invention is to provide an electronic encoder and method of operation that is smaller in size.

Another object of the present invention is to provide an electronic encoder and method of operation that contains fewer components.

Still another object of the present invention is to provide an electronic encoder and method that improves reliability.

Yet another object of the present invention is to provide an electronic encoder and method that is compatible with existing designs.

Another object of the present invention is to provide an electronic encoder and method that can perform self testing.

Still another object of the present invention is to provide an electronic encoder and method that is more economical.

Yet another object of the present invention is to provide an electronic encoder and method that is a self contained system.

The above and other objects and advantages of the present invention are provided by an electronic encoder and method of operation that replaces the prior art mechanical devices with integrated circuits and the like.

A particular embodiment of the present invention consists of an electronic encoder, for use in setting munitions and the like, comprising: switch means for activating and setting the electronic encoder; display means for displaying the setting of the electronic encoder; driving means for driving the display; selecting means for selecting a portion of the display means to be set; and setting means for setting the portion of the display means.

BRIEF DESCRIPTION OF THE DRAWINGS

FIGS. 2A–2H are pictorial diagrams of a display of the electronic encoder of FIG. 1;

DETAILED DESCRIPTION OF THE DRAWINGS

Figure 1:
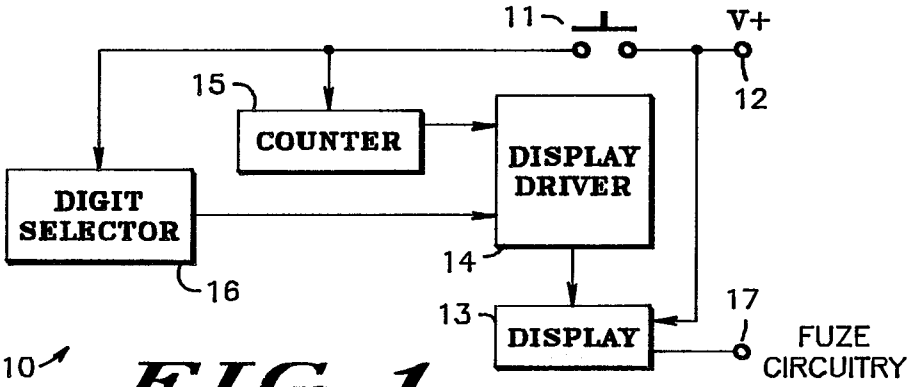
FIG. 1 is a block diagram illustrating a first embodiment of the present invention.

Referring now to the diagram of FIG. 1, a block diagram, generally designated 10, embodying the present invention is illustrated. Circuit 10 consists of a switch 11, a power supply node 12, a display 13, a display driver 14, a counter 15, a digit selector 16, and output node 17 coupled to the fuze circuitry.

In operation when button 11 is depressed and released, the first time, display 13 is activated. Display 13 would generally start with a display of all zeros as is shown in FIG. 2A. Here the display is shown as all zeros with the first zero underscored. This initial display is set by counter 15, which selects the zeros, and digit selector 16, which places the underscore. The underscore indicates that the first digit is ready to be set. Depressing button 11 a second time and holding the button down will cause counter 15 to count through a set of numbers or other characters. When the correct number is shown on display 13, see FIG. 2B, button 11 is released. This causes digit selector 16 to move the underscore from under the first digit to the second digit as shown in FIG. 2C. The second number may then be set as the first number was. This procedure is then followed for the remaining digits until all are set. This may be seen in FIGS. 2D–2H.

The data that is shown on display 13 is also transmitted to node 17 and on to the fuze circuitry. This data is generally not accepted by the fuze circuitry until a preset sequence of events occurs that is generally referred to as the launch sequence.

Figure 3:
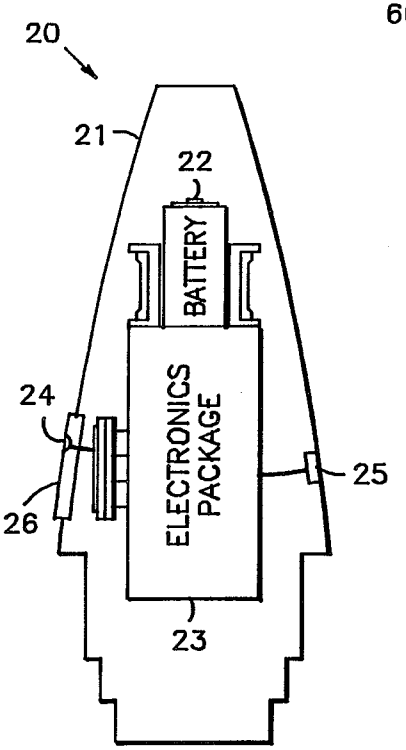
FIG. 3 is a block diagram of one embodiment of an electronic encoder fuze packaging concept embodying the present invention.

Referring now to the diagram of FIG. 3, a block diagram of one embodiment of an electronic encoder fuze packaging concept, generally designated 20, is illustrated. Fuze package 20 consists of an outer housing 21; a battery 22; an electronics package 23; a display 24; a switch 25 and a window 26. Housing 21 contains the electronic encoder in addition to various other devices that may be placed in munitions.

Button 25 is located on the outer surface of housing 21 and is the equivalent of button 11, FIG. 1. Battery 22 is provided as the power supply to the electronic encoder. Display 24 is the equivalent of display 13, FIG. 1. A window 26 is set in housing 21 to display 24 to be viewed.

Figure 4:
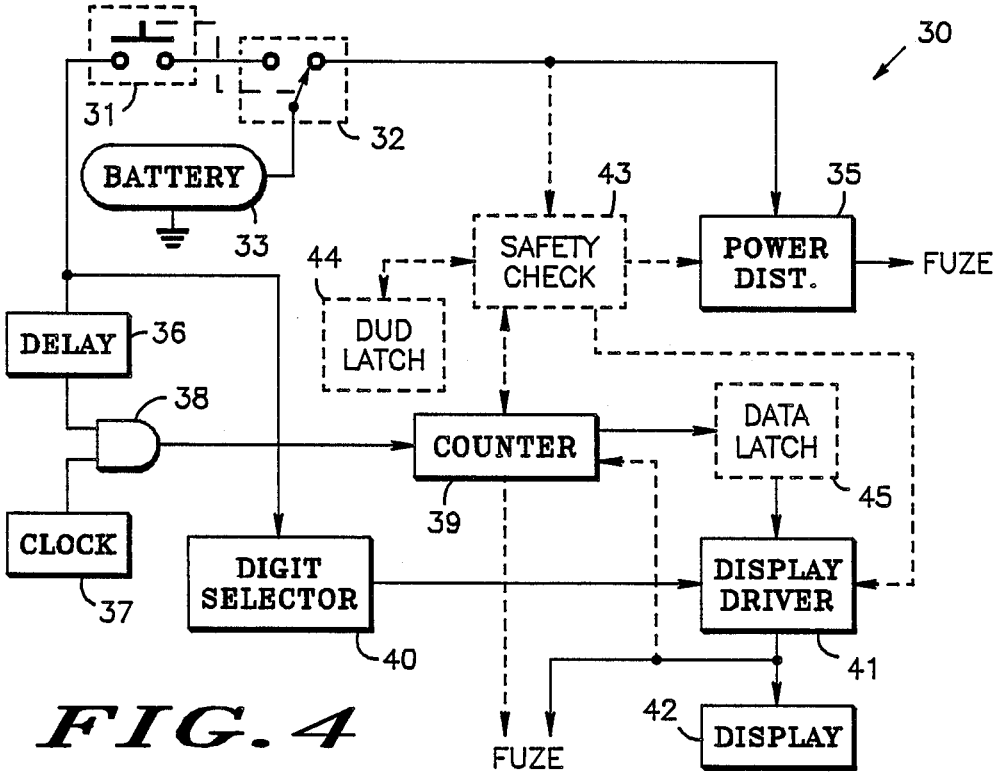
FIG. 4 is a block diagram illustrating a second embodiment of the present invention.

Referring now to FIG. 4, a second embodiment of an electronic encoder, generally designated 30, embodying the present invention is illustrated. Electronic encoder 30 consists of a push button switch 31; a battery switch 32; a battery 33; a power distributor 35; a delay 36; a clock 37 and a logic gate 38. Encoder 30 also includes a counter 39; a digit selector 40; a display driver 41; and a display 42. In addition to the above, encoder 30 may include the following optional circuits: a safety check 43; a dud latch 44; and a data latch 45.

In operation button 31 is depressed. This causes switch 32 to be closed connecting battery 33 to the rest of encoder 30. In one method of operation display 42 will be activated causing all of the display segments, or lights, to be activated. This is a test to see if all the segments are operational. When button 31 is depressed a second time, display 42 goes blank. This shows that the segments, or lights, are not frozen in the on position. When button 31 is depressed a third time display 42 comes up all zeros with the first digit underscored, see FIG. 2A. If button 31 is held down for a time in excess of the setting in delay 36, a signal is output from delay 36 to logic gate 38. Logic gate 38 consists of a dual input AND gate. The second port of logic gate 38 is coupled to clock 37. When delay 36 transmits a signal to logic gate 38 the clock pulses from clock 37 are allowed to pass through gate 38 to counter 39. This causes counter 39 to increment and output an incrementing signal. This incrementing signal is sent to display driver 41 which causes display 42 to show the number indicated by counter 39. The output of display driver 41 is transmitted to the fuze.

In addition to the above, when button 31 is first depressed and battery 33 is coupled to the rest of encoder 30, power distribution 35 is activated to provide power to the fuze.

There are also several optional circuits and connections that may be used in encoder 30. These options are illustrated in FIG. 4 using dotted lines and boxes. These options consist of a safety check 43; a dud latch 44; and a data latch 45. In operation, with the options, when button 31 is first depressed, safety check 43 operates a system check. Safety check 43 can check any number of things, here safety check 43 is shown checking power distribution 35, display driver 41 and counter 39. Safety check 43 checks power distributor 35 to insure that the power to the fuze is adequate. Display driver 41 is checked to insure that the number input to driver 41 is the same as the number output from driver 41. Counter 39 is checked to insure that it is incrementing, or counting, properly. If these subsystems check out satisfactorily then safety check 43 allows the process to continue. If any abnormalities arise during the check then safety check 43 will inhibit power distribution 35, display driver 41 and counter 39. In addition, safety check 43 will activate dud latch 44. Dud latch 44 operates to prevent the fuze from being set.

Another optional device is data latch 45. Data latch 45 receives a signal from counter 39 and, in turn, transmits this signal to display driver 41. Data latch 45 is provided to cause the data being sent from counter 39 to display driver 41 to be sent at intervals consistent with the timing of the rest of encoder 30 and the accompanying fuze.

In addition, the output of display driver 41 may be coupled to counter 39. This provides a cross check to insure that the number output from driver 41 is the same as the number in counter 39. An output from counter 39 then provides the data to the fuze.

This type of electronic encoder can replace existing mechanical encoders and takes much less space. In addition, as can be seen from FIGS. 3–5 the present invention is a self contained unit needing no external circuitry to function.

Figure 5:
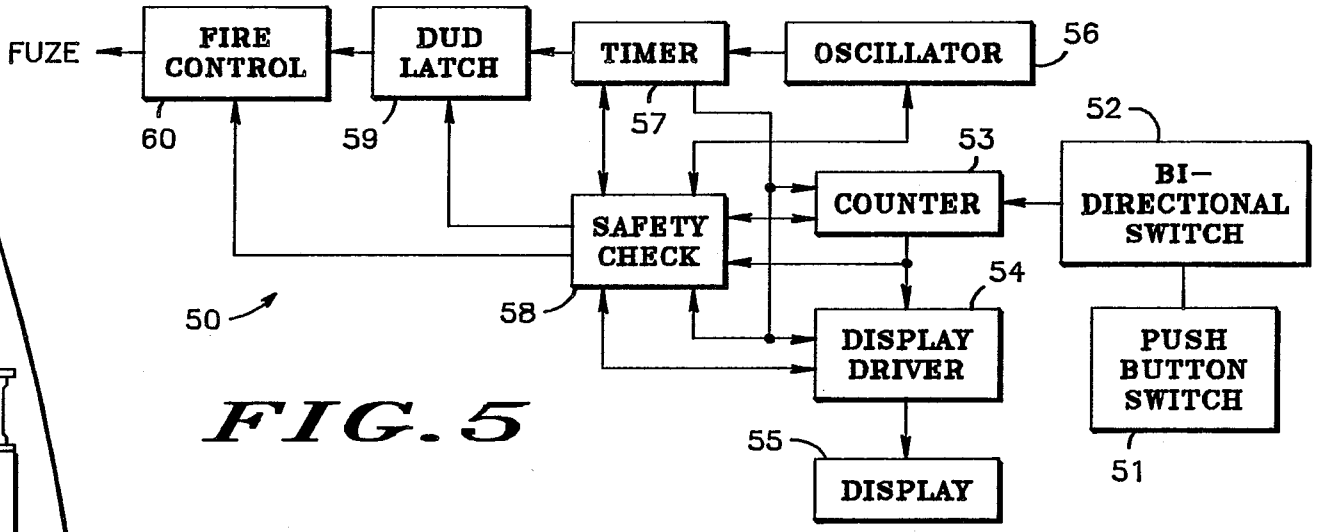
FIG. 5 is a block diagram of a third embodiment of the present invention.

Referring now to the diagram of FIG. 5, an electronic encoder, generally designated 50, embodying the present invention is illustrated. Encoder 50 consists chiefly of a push button switch 51; a bidirectional switch 52; a counter 53; a display driver 54 and a display 55. In addition, encoder 50 consists of: an oscillator 56; a timer 57; a safety check 58; a dud latch 59 and a fire control 60.

In operation, push button switch 51 is depressed. This releases a mechanical lock from bidirectional switch 52 allowing switch 52 to be rotated. In one example bidirectional switch 52 is an ogive on a munition. An ogive is the cone structure or nose portion of the munition. Bidirectional switch 52 may be rotated in one of two directions, which for the ease of discussion will be referred to as the first and second directions. When switch 52 is first rotated in the first direction a battery (not shown) is engaged providing power to encoder 50. When the battery is first engaged a safety check is performed by safety check 58.

As can be seen in FIG. 5, safety check 58 operates to check the display driver 54; oscillator 56; timer 57; fire control 60; and counter 53. Safety check 58 checks: driver 54 to insure that the number input to driver 54 is the same as the number output from driver 54; oscillator 56 to see that it is oscillating at the proper rate, or frequency; timer 57 to see that it is running at the proper rate; fire control 60 to see that the proper information is being output to the fuze; and counter 53 to insure that it is incrementing, or counting, properly. Safety check 58 also operates dud latch 59 to prevent the fuze from being set if any of the safety checks are not satisfactory.

Once the safety check has been satisfactorily completed counter 53 is activated which causes a signal to be sent to display driver 54. Display driver 54 causes all of the segments of display 55 to be lit as a test as to whether all the segments, or lights, are operational.

Next, switch 52 is rotated a second time in the first direction. This causes all the lights, or segments, of display 55 to go blank. This is a check to ensure that none of the lights are frozen in the on position. Upon a third rotation of switch 52 in the first direction display 55 will show all zeros with the first, or most significant, digit underlined. Encoder 50 is now in the setting mode.

To set encoder 50, switch 52 is turned in the first direction. This causes counter 53 to increment from 0 thru 9 and any alpha characters that may be included. Oscillator 56 serves as the clock for counter 53, display driver 54 and timer 57. Once display 55 indicates the desired character, switch 52 is rotated in the second direction. This causes the line under the segments of display 55 to move to the next most significant digit as was shown in FIG. 2C. At this time the process of setting the first digit is repeated. This process is repeated until all of the segments are set. It should be noted here that there are many different methods that may be utilized in setting encoder 50. Another method would involve a situation where there are very few settings available for the particular encoder. In this situation only the first digit may be required to be set and the remaining digits would be set by default according to the first digit. As an example, if the device that encoder 50 were attached to was to be set to go off upon impact then the most significant digit may be set to an "I". Once this is done the remaining digits would be set to an appropriate display such as "MPT" making the display read "IMPT".

By using an electronic encoder, such as that shown in FIG. 5, a more reliable switch is provided, partly because of the ability to preform a self-test. In addition, an electronic encoder having fewer components and costing less to produce is provided.

Figure 6:
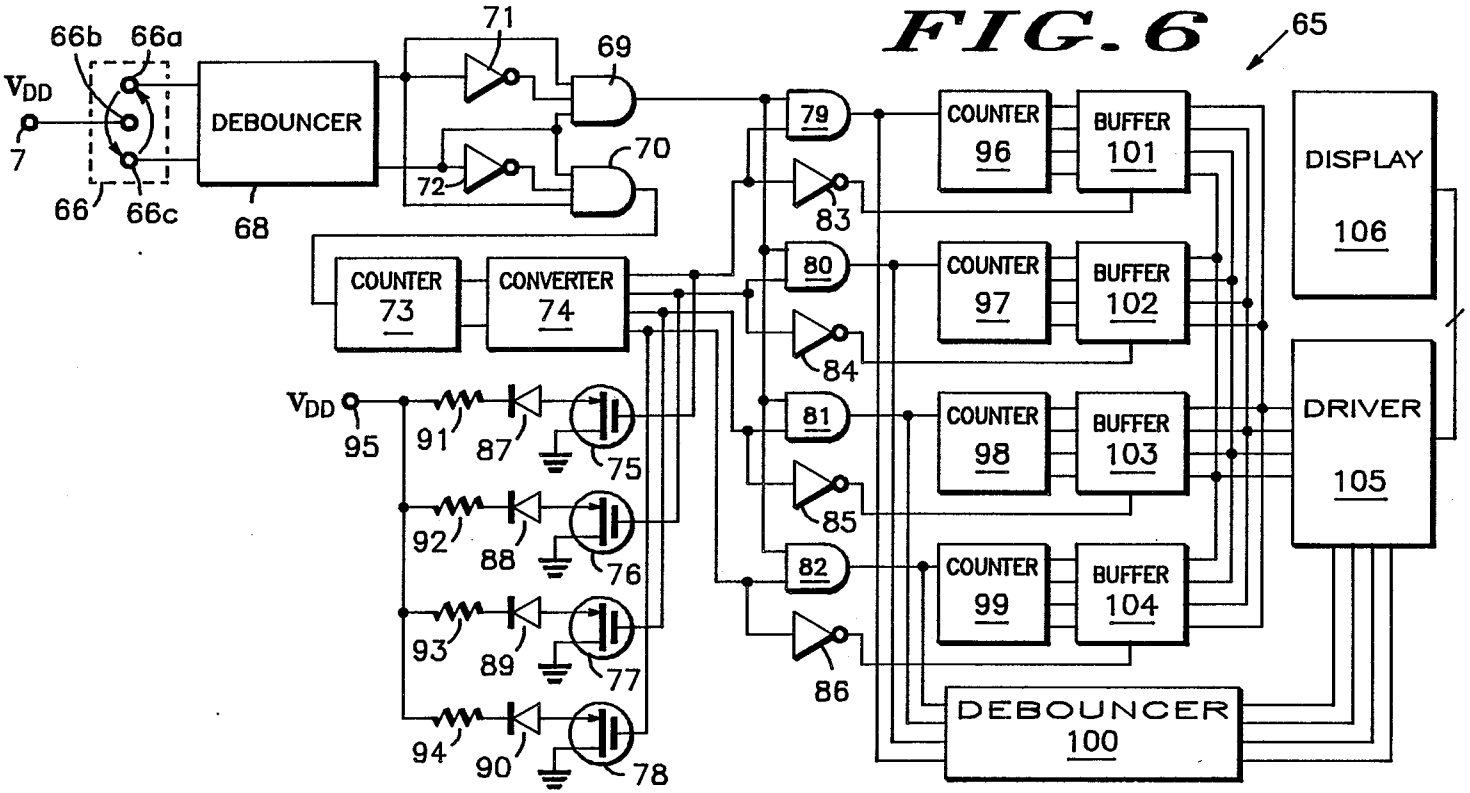
FIG. 6 is a schematic diagram of an electronic encoder embodying the present invention.

Referring now to FIG. 6 a schematic diagram of an electronic encoder, generally designated 65, is illustrated. Encoder 65 consists of a switch 66 having ports *66a, 66b,* and *66c.* Port *66b* is coupled to a power supply node 67. Ports *66a* and *66c* are coupled to a dual input, dual output switch debouncer 68, such as Motorola's MC14490. Switch debouncer 68 operates to eliminate switch noise from switch 66. The first output of debouncer 68 is coupled to a first input of a three input AND gate 69, such as Motorola's MC14073; to a third input of a three input AND gate 70; and to the input of an invertor 71, which acts as a delay. The output of inverter 71 is coupled to the second input of AND gate 69. The second output of debouncer 68 is coupled to a third input of AND gate 69; to a first input of AND gate 70; and to the input of an inverter 72 which functions as a delay. The output of inverter 72 is coupled to the second input of AND gate 70.

The output of AND gate 70 is coupled to a counter 73, such as Motorola's MC14520. The output of counter 73 is coupled to a binary-to-digital convertor 74, such as Motorola's MC14555. The first output of convertor 74 is coupled to a gate of a field effect transistor (FET) 75, such as Motorola's 2N4351; to a first input of a dual input AND gate 79, such as Motorola's MC14081; and to the input of an inverter 83. The second output of convertor 74 is coupled to a gate of a FET 76; to a first input of a dual input AND gate 80; and to the input of an inverter 84. The third output of convertor 74 is coupled to a gate of a FET 77; to a first input of a dual input AND gate 81; and to the input of an inverter 85. The fourth output of convertor 74 is coupled to a gate of a FET 78; to a first input of a dual input AND gate 82; and to the input of an inverter 86.

The drains of FETs 75–78 are coupled to ground. The sources of FETs 75–78 are coupled to the anodes of diodes 87–90, resp. The cathodes of diodes 87–90 are coupled to one end of resistors 91–94, resp. The second ends of resistors 91–94 are coupled to a power supply node 95.

The second inputs of AND gates 79–82 are coupled to the output of AND gate 69. The outputs of AND gates 79–82 are coupled to the inputs of binary coded decimal (BCD) counters 96–99, such as Motorola's MC14518. The outputs of AND gates 79–82 are also coupled to a switch debouncer 100.

The decimal outputs of counters 96–99 are coupled to the inputs of buffers 101–104, resp., such as Motorola's MC14503. The outputs of inverters 83–86 are coupled to buffers 101–104, resp., and serve to activate buffers 101–104. The output of buffers 101–104 are coupled to the input of a display driver 105, such as Intersil's 7211. Display driver 105 is clocked by the output of debouncer 100. The output of driver 105 is coupled to the input of a display 106.

In operation, switch 66 of encoder 65 is activated. Switch 66 is a leaf type spring switch which may be activated in one of two directions. First, node *66c* is pushed into node *66b* which is pushed into node *66a.* This will cause a signal to be output from one of AND gates 69 or 70. When switch 66 is activated in the opposite direction, node *66a* is pushed into node *66b* which is pushed into node *66c,* a signal is output from the other AND gate 69 or 70. The signals output from and gates 69 and 70 consist of a pulse having a duration set by delays 71 or 72, resp.

A signal output from AND gate 70 is transmitted to counter 73. For each pulse received from AND gate 70 counter 73 will increment. The output of counter 73 is output along two lines to convertor 74. Only two lines are shown here since we are presently only concerned with four possible states. Should additional states be required, additional lines could be added. The decimal output of counter 73 is output by converter 74 to FETs 75–78. Only one of FETs 75–78 will be activated at one time depending on the signal from switch 66. These FETs are set to activate one of the underline segments of the display illustrated in FIG. 2, display A. FETs 75–78 drive diodes 87–90. Diodes 87–90 are light emitting diodes and represent the lines under the display numbers of FIG. 2. Resistors 91–94 act to limit the current through diodes 87–90. The output from converter 74 also acts to activate one of AND gates 79–82 and one of inverters 83–86 which activates a corresponding buffer 101–104, resp.

When switch 66 is operated in a direction to produce a signal pulse from AND gate 69, this pulse is transmitted to AND gates 79–82. One of AND gates 79–82 has been activated by the output from converter 74. This active AND gate will output a pulse to one of the counters 96–99, causing that counter to increment once for each pulse, and will also supply the pulse to debouncer 100. For example, it will be assumed that AND gate 79 is the one currently activated by counter 74. Each time a pulse is received by AND gate 79 from AND gate 69 a pulse will be output to counter 96. Counter 96 will increment and transmit a corresponding decimal signal to buffer 101. Buffer 101 has been activated by the output from inverter 83 which is controlled by the same output from converter 74 that activated AND gate 79. This allows the output from counter 96 to pass through buffer 101 and be transmitted to driver 105.

The output from AND gate 79 is also transmitted to debouncer 100 where the signal is filtered and transmitted to driver 105. This signal indicates to driver 105 which one of the displays the data from buffer 101 is to be loaded into and acts to clock driver 105 causing it to accept the signal from buffer 101. Driver 105 then acts to drive display 106 causing the number indicated by counter 96 to be indicated.

Once that number has been set switch 66 can be rotated in the first direction again, causing the underline indicator of display 106 to move. The process of moving the indicator and setting the indicated digit, see FIG. 2 and accompanying discussion, is then repeated until all the digits are set as desired. Encoder 65, as shown, would have a four digit display 106. It would be obvious to one skilled in the art that this may be increased or reduced to any number of desired display digits.

Thus, it is apparent to one skilled in the art, that there has been provided in accordance with the invention, a device and method that fully satisfies the objects, aims and advantages set forth above.

It has been shown that the present invention provides an electronic encoder and method of operation that operates electronically rather than mechanically; that is smaller in size; is more reliable; has fewer components; and is more economical to produce. In addition the present invention is capable of performing self-testing and is compatible with existing mechanical encoders.

While the invention has been described in conjunction with specific embodiments thereof, it is evident that many alterations, modifications, and variations will be apparent to those skilled in the art in light of the foregoing specification. Accordingly, it is intended to embrace all such alterations, modifications and variations in the appended claims.

We claim:

1. An electronic encoder for use in setting munitions and the like, said electronic encoder having a power supply node and an output, said electronic encoder comprising:

switch means for activating and setting said electronic encoder, said switch means having a first node and a second node, said second node being coupled to a power supply node;

display means for displaying the setting of said electronic encoder, said display means having an input, an output and an enable, said enable being coupled to said power supply node and to said second node of said switch means, and said output being coupled to said output of said electronic encoder;

driving means for driving said display means, said driving means having a first input, a second input and an output, said output being coupled to said input of said display means;

selecting means for selecting a portion of said display means to be set, said selecting means having an input and an output, said input being coupled to a first node of said switch means and said output being coupled to said second input of said driving means; and setting means for setting said portion of said display means, said setting means having an input and an output, said input being coupled to said first node of said switch means and said output being coupled to said first input of said driving means.

2. The electronic encoder of claim 1 further comprising safety means for performing a safety check on said electronic encoder, said safety means being coupled to at least one of said switch means, display means, driving means, selecting means and setting means.

3. The electronic encoder of claim 1 wherein said switch means comprises a push button switch having a first node and a second node, said first node being coupled to said inputs of said selecting and setting means and said second node being coupled to said enable of said display means.

4. The electronic encoder of claim 1 wherein said switch means comprises:

primary switch means for activating and setting said electronic encoder, said primary switch means having a safety lock and being coupled to said selecting and setting means; and secondary switch means for releasing said safety lock of said primary switch means, said secondary switch means being coupled to said primary switch means.

5. The electronic encoder of claim 1 wherein said display means comprises at least one eight segment display device.

6. The electronic encoder of claim 1 wherein said setting means comprises a counter having an input and an output, said input being coupled to said first node of said switch means and said output being coupled to said driving means.

7. An electronic encoder for use in setting munitions and the like, said electronic encoder having an output and comprising:

display means for displaying the setting of said electronic encoder, said display means having an input;

driving means for driving said display means, said driving means having a first input, a second input and an output, said output being coupled to said input of said display means and to a fuze;

selecting means for selecting a portion of said display means to be set, said selecting means having an input and an output, said output being coupled to said second input of said driving means;

switch means for activating and setting said electronic encoder, said switch means having a first node and a second node, said first and second nodes being coupled when said switch means is activated and said first node being coupled to said input of said selecting means;

power supply means for providing power to said electronic encoder, said power supply means having a ground and a port, said port being coupled to said second node of said switch means;

delay means for delaying a signal from said switch means, said delay means having an input and an output, said input being coupled to said first node of said switch means;

a logic gate having a first input, a second input and an output, said first input being coupled to said ouput of said delay means;

clock means for providing a clock pulse, said clock means having an output coupled to said second input of said logic gate; and setting means for setting said portion of said display means, said setting means having an input and an output, said input being coupled to said output of said logic gate and said output being coupled to said first input of said driving means.

8. The electronic encoder of claim 7 wherein said display means comprises at least one eight segment display device.

9. The electronic encoder of claim 7 wherein said switch means comprises a push button switch having a first node and a second node, said first node being coupled to said inputs of said selecting and delay means and said second node being coupled to said port of said power supply means.

10. The electronic encoder of claim 7 wherein said switch means comprises:

primary switch means for activating and setting said electronic encoder, said primary switch means having a safety lock and being coupled to said selecting and delay means; and secondary switch means for releasing said safety lock of said primary switch means, said secondary switch means being coupled to said primary switch means.

11. The electronic encoder of claim 7 wherein said setting means comprises a counter having an input and an output, said input being coupled to said first node of said switch means and said output being coupled to said driving means.

12. The electronic encoder of claim 7 further comprising latching means for storing a signal from said setting means, said latching means having an input and an output, said input being coupled to said output of said setting means and said output being coupled to said input of said driver means.

13. The electronic encoder of claim 7 further comprising power distributing means for providing power to said fuze, said power distributing means having an input and an output, said input being coupled to said port of said power supply means and said output being coupled to said fuze.

14. The electronic encoder of claim 7 further comprising safety means for performing a safety check on said electronic encoder, said safety means being coupled to at least one of said switch means, display means, driving means, selecting means and setting means.

15. The electronic encoder of claim 14 further comprising dud latch means for inhibiting said fuze from operating, said dud latch means being coupled to said safety means.

16. An electronic encoder for use in setting munitions and the like, said electronic encoder having an output and comprising:

switch means for activating and setting said electronic encoder, said switch means having an output;

setting means for setting said electronic encoder, said setting means having first and second inputs, an output and a bus, said first input being coupled to said output of said switch means;

display means for displaying the setting of said electronic encoder, said display means having an input;

driving means for driving said display means, said driving means having first and second inputs, an output and a bus, said first input being coupled to said output of said setting means and said output being coupled to said input of said display means;

timing means having an input, first and second outputs and a bus, said second output being coupled to said second input of said setting means and to said driving means;

an oscillator having an output and a bus, said output being coupled to said input of said timing means;

dud latch means for inhibiting a fuze from operating, said dud latch means having an input, an output and a bus, said input being coupled to said second output of said timing means;

control means for controlling the firing of said fuze, said fire control means having an input, an output and a bus, said input being coupled to said output of said dud latch means and said output being coupled to said fuze; and safety means for performing a safety check on said electronic encoder, said safety means having a first input, a second input and first, second, third, fourth, fifth and sixth busses, said first input being coupled to said output of said setting means, said second input being coupled to said timing means, said first bus being coupled to said bus of said timing means, said second bus being coupled to said bus of said oscillator, said third bus being coupled to said bus of said setting means, said fourth bus being coupled to said bus of said driver means, said fifth bus being coupled to said bus of said control means, and said sixth bus being coupled to said bus of said dud latch means.

17. The electronic encoder of claim 16 wherein said switch means comprises:

a bidirectional switch having an output and a safety lock, said output being coupled to said first input of said setting means; and key switch means for unlocking said safety lock on said bidirectional switch.

18. The electronic encoder of claim 16 wherein said setting means comprises a counter having a first input, a second input, an output and a bus, said first input being coupled to said output of said switch means, said second input being coupled to said timing means, said output being coupled to said driver means, and said bus being coupled to said third bus of said safety means.

19. The electronic encoder of claim 16 wherein said display means comprises at least one eight segment display device.

20. An electronic encoder for use in setting munitions and the like, said electronic encoder having an output and comprising:

switch means having first, second and third ports, said second port being coupled to a power supply;

a first filter having first and second inputs and first and second outputs, said first input being coupled to said first port of said switch means and said second port being coupled to said third port of said switch means;

a first logic gate having first, second and third inputs and an output, said first input being coupled to said first output of said first filter and said third input being coupled to said second output of said first filter;

a second logic gate having first, second and third inputs and an output, said first input being coupled to said first output of said first filter, and said third input being coupled to said second output of said first filter;

a first delay having an input and an output, said input being coupled to said first output of said first filter and said output being coupled to said second input of said first logic gate;

a second delay having an input and an output, said input being coupled to said second output of said first filter and said output being coupled to said second input of said second logic gate;

a first counter having an input and an output, said input being coupled to said output of said second logic gate;

a binary-to-decimal convertor having an input and an output, said input being coupled to said output of said first counter;

a transistor having a gate, a source and a drain, said gate being coupled to said output of said binary-to-decimal convertor and said drain being coupled to ground;

a diode having an anode and a cathode, said cathode being coupled to said source of said transistor;

a resistor having first and second ports, said first port being coupled to said anode of said diode and said second port being coupled to said power supply;

a third logic gate having first and second inputs and an output, said first input being coupled to said output of said first logic gate and said second input being coupled to said output of said binary-to-decimal convertor;

a third delay having an input and an output said input being coupled to said output of said binary-to-decimal convertor;

a second counter having an input and an output said input being coupled to said output of said third logic gate;

a buffer having an input, an output and a clock, said input being coupled to said buffer and said clock being coupled to said output of said third delay;

a second filter having an input and an output, said input being coupled to said output of said third logic gate;

a display driver having an input, an output and an enable, said input being coupled to said output of said buffer and said enable being coupled to said output of said second filter; and a display having an input coupled to said output of said display driver.

21. The electronic encoder of claim 20 wherein said first, second and third logic gates are AND gates.

22. The electronic encoder of claim 20 wherein said first, second and third delays are inverters.

23. The electronic encoder of claim 20 wherein said second counter comprises a binary coded decimal counter.

* * * * *